US008564529B2

(12) United States Patent
Kurokawa et al.

(10) Patent No.: US 8,564,529 B2
(45) Date of Patent: Oct. 22, 2013

(54) METHOD FOR DRIVING LIQUID CRYSTAL DISPLAY DEVICE

(75) Inventors: Yoshiyuki Kurokawa, Sagamihara (JP); Takayuki Ikeda, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 279 days.

(21) Appl. No.: 13/150,686

(22) Filed: Jun. 1, 2011

(65) Prior Publication Data

US 2011/0310132 A1 Dec. 22, 2011

(30) Foreign Application Priority Data

Jun. 21, 2010 (JP) ..... 2010-140886

(51) Int. Cl.
*G09G 3/36* (2006.01)

(52) U.S. Cl.
USPC ..... 345/102; 345/82

(58) Field of Classification Search
USPC ..... 345/102, 690, 82
See application file for complete search history.

(56) References Cited

U.S. PATENT DOCUMENTS

| | | | |
|---|---|---|---|
| 6,448,951 | B1 | 9/2002 | Sakaguchi et al. |
| 6,590,553 | B1 | 7/2003 | Kimura et al. |
| 6,597,348 | B1 | 7/2003 | Yamazaki et al. |
| 6,873,311 | B2 | 3/2005 | Yoshihara et al. |
| 6,882,012 | B2 | 4/2005 | Yamazaki et al. |
| 6,903,731 | B2 | 6/2005 | Inukai |
| 7,113,164 | B1 | 9/2006 | Kurihara |
| 7,145,536 | B1 | 12/2006 | Yamazaki et al. |
| 7,193,593 | B2 | 3/2007 | Koyama et al. |
| 7,224,339 | B2 | 5/2007 | Koyama et al. |
| 7,268,756 | B2 | 9/2007 | Koyama et al. |
| 7,317,438 | B2 | 1/2008 | Yamazaki et al. |
| 7,362,304 | B2 | 4/2008 | Takatori et al. |
| 7,385,579 | B2 | 6/2008 | Satake |

(Continued)

FOREIGN PATENT DOCUMENTS

| | | | |
|---|---|---|---|
| JP | 2002-062518 | A | 2/2002 |
| JP | 2006-220685 | A | 8/2006 |
| JP | 2007-264211 | A | 10/2007 |
| JP | 2009-042405 | A | 2/2009 |

OTHER PUBLICATIONS

Baron et al., "36.4: Can Motion Compensation Eliminate Color Breakup of Moving Objects in Field-Sequential Color Displays?" SID Digest '96: SID International Symposium Digest of Technical Papers, 1996, vol. 27, pp. 843-846.

(Continued)

*Primary Examiner* — Kevin M Nguyen
(74) *Attorney, Agent, or Firm* — Eric J. Robinson; Robinson Intellectual Property Law Office, P.C.

(57) ABSTRACT

Image quality of a field-sequential liquid crystal display device is improved by increasing the frequency of input of an image signal. Among pixels arranged in matrix, image signals are concurrently supplied to pixels provided in a plurality of rows. Thus, the frequency of input of an image signal to each of the pixels of the liquid crystal display device can be increased. As a result, in the liquid crystal display device, display deterioration such as color break which is caused in a field-sequential liquid crystal display device can be suppressed and image quality can be improved.

15 Claims, 10 Drawing Sheets

(56) References Cited

U.S. PATENT DOCUMENTS

| | | | | |
|---|---|---|---|---|
| 7,403,177 | B2 | 7/2008 | Tanada et al. | |
| 7,425,937 | B2 | 9/2008 | Inukai | |
| 7,564,443 | B2 | 7/2009 | Takatori et al. | |
| 7,702,705 | B2 | 4/2010 | Suzuki | |
| 7,773,066 | B2 | 8/2010 | Yamazaki et al. | |
| 7,791,571 | B2 | 9/2010 | Ohtani et al. | |
| 7,834,830 | B2 | 11/2010 | Yamazaki et al. | |
| 7,855,770 | B2 | 12/2010 | Egi et al. | |
| 7,941,471 | B2 | 5/2011 | Katz et al. | |
| 2002/0000960 | A1 | 1/2002 | Yoshihara et al. | |
| 2002/0044140 | A1 | 4/2002 | Inukai | |
| 2002/0075249 | A1 | 6/2002 | Kubota et al. | |
| 2004/0056831 | A1 | 3/2004 | Takatori et al. | |
| 2004/0113906 | A1 | 6/2004 | Lew et al. | |
| 2004/0257324 | A1 | 12/2004 | Hsu | |
| 2005/0012097 | A1 | 1/2005 | Yamazaki | |
| 2006/0007102 | A1* | 1/2006 | Yasuoka et al. | 345/102 |
| 2007/0139354 | A1 | 6/2007 | Kim et al. | |
| 2007/0216616 | A1 | 9/2007 | Stessen | |
| 2007/0279359 | A1 | 12/2007 | Yoshida et al. | |
| 2007/0279374 | A1 | 12/2007 | Kimura et al. | |
| 2008/0158140 | A1 | 7/2008 | Takatori et al. | |
| 2008/0238336 | A1 | 10/2008 | Peng et al. | |
| 2009/0028460 | A1 | 1/2009 | Jung et al. | |
| 2009/0096724 | A1* | 4/2009 | Ichikawa et al. | 345/82 |
| 2009/0167670 | A1 | 7/2009 | Peng et al. | |
| 2009/0219243 | A1 | 9/2009 | Chen | |
| 2009/0237004 | A1 | 9/2009 | Ploquin et al. | |
| 2009/0321737 | A1 | 12/2009 | Isa et al. | |
| 2010/0148177 | A1 | 6/2010 | Koyama et al. | |
| 2010/0149084 | A1 | 6/2010 | Chida | |
| 2010/0182282 | A1 | 7/2010 | Kurokawa et al. | |
| 2010/0235418 | A1 | 9/2010 | Dong | |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |
| 2011/0157216 | A1 | 6/2011 | Yamazaki et al. | |
| 2011/0157253 | A1 | 6/2011 | Yamazaki et al. | |

OTHER PUBLICATIONS

Kurita et al., "Evaluation and Improvement of Picture Quality for Moving Images on Field-sequential Color Displays," IDW '00: Proceedings of the 17th International Display Workshops, 2000, pp. 69-72.

Taira et al., "A 15" Field-Sequential Display without Color Break-Up using an AFLC Color Shutter," IDW '00: Proceedings of the 17th International Display Workshops, 2000, pp. 73-76.

Jarvenpaa, "7.2: Measuring Color Breakup of Stationary Images in Field-Sequential-Color Displays," SID Digest '04: SID International Symposium Digest of Technical Papers, 2004, vol. 35, pp. 82-85.

* cited by examiner

METHOD FOR DRIVING LIQUID CRYSTAL DISPLAY DEVICE

BACKGROUND OF THE INVENTION

1. Field of the Invention

The present invention relates to methods for driving liquid crystal display devices. In particular, the present invention relates to methods for driving field-sequential liquid crystal display devices.

2. Description of the Related Art

As display methods of liquid crystal display devices, a color filter method and a field sequential method are known. In such a color-filter liquid crystal display device, a plurality of subpixels which have color filters for transmitting only light with wavelengths of given colors (e.g., red (R), green (G), and blue (B)) are provided in each pixel. A desired color is expressed by control of transmission of white light in each subpixel and mixture of a plurality of colors in each pixel. In contrast, in such a field-sequential liquid crystal display device, a plurality of light sources that emit light of different colors (e.g., red (R), green (G), and blue (B)) are provided. A desired color is expressed by repeatedly blinking each of the plurality of light sources and controlling transmission of light of each color in each pixel. In other words, a color filter method is a method in which a desired color is expressed by division of the area of one pixel among given colors, and a field sequential method is a method in which a desired color is expressed by division of a display period among given colors.

The field-sequential liquid crystal display device has the following advantages over the color-filter liquid crystal display device. First, in the field-sequential liquid crystal display device, it is not necessary to provide subpixels in each pixel. Thus, the aperture ratio can be improved or the number of pixels can be increased. Further, in the field-sequential liquid crystal display device, it is not necessary to provide color filters. That is, light loss caused by light absorption in the color filters does not occur. Therefore, transmittance can be improved and power consumption can be reduced.

Patent Document 1 discloses a display method of a liquid crystal display device which performs display by a field sequential method. Specifically, a color display method of a liquid crystal display device is disclosed in which red (R) light, green (G) light, and blue (B) light are sequentially emitted and then, black display is performed.

REFERENCE

Patent Document

[Patent Document 1] Japanese Published Patent Application No. 2007-264211

SUMMARY OF THE INVENTION

In a field-sequential liquid crystal display device, it is necessary to increase the frequency of input of an image signal to each pixel. For example, in the case where images are displayed by a field sequential method in a liquid crystal display device including three light sources, which emit light of respective colors of red (R), green (G), and blue (B), the frequency of input of an image signal to each pixel needs to be at least three times as high as that of a color-filter liquid crystal display device. Specifically, in the case where the frame frequency is 60 Hz, an image signal needs to be input to each pixel 60 times per second in the color-filter liquid crystal display device; whereas an image signal needs to be input to each pixel 180 times per second in the case where images are displayed by a field sequential method in the liquid crystal display device including the three light sources.

Note that, for an increase in the frequency of input of image signals, an element provided in each pixel needs to have high response speed. Specifically, a transistor provided in each pixel needs to have higher mobility, for example. However, it is not easy to improve the characteristics of the elements.

It is possible to display images by a field sequential method in a conventional liquid crystal display device in which the frame frequency is low. However, display deterioration such as color break becomes obvious in that case, which is a problem.

In view of the above, one object of one embodiment of the present invention is to improve image quality of a field-sequential liquid crystal display device by improving the frequency of input of image signals by a method not limited by element characteristics.

The object can be achieved by concurrent supply of image signals to pixels provided in a plurality of rows among pixels arranged in matrix in a pixel portion of a liquid crystal display device.

That is, one embodiment of the present invention is a method for driving a liquid crystal display device configured to produce an image in a pixel portion by repeatedly blinking each of a plurality of light sources emitting light of different colors and controlling transmission of the light of each color in each of a plurality of pixels provided in m rows and n columns (m and n are natural numbers that are 4 or more). In the driving method, in a first sampling period, supply of an image signal for controlling transmission of light of a given color for respective n pixels provided in the first to k-th rows and supply of an image signal for controlling transmission of the light of the given color for respective n pixels provided in the (k+1)th to 2k-th rows are concurrently performed; in a second sampling period subsequent to the first sampling period, light of the given color is emitted to the pixel portion by lighting at least one of the plurality of light sources emitting the light of the different colors, and transmission of the light of the given color is controlled in each of the respective n pixels provided in the first to 2k-th rows.

In the liquid crystal display device according to one embodiment of the present invention, image signals can be concurrently supplied to pixels provided in a plurality of rows among pixels arranged in matrix. Thus, without being limited by the characteristics such as mobility of a transistor included in the liquid crystal display device, the frequency of input of an image signal to each pixel can be increased. As a result, in the liquid crystal display device, display deterioration such as color break which is caused in a field-sequential liquid crystal display device can be suppressed and image quality can be improved.

DETAILED DESCRIPTION OF THE INVENTION

Embodiments of the present invention will be described below in detail with reference to the drawings. Note that the present invention is not limited to the following description. It will be readily appreciated by those skilled in the art that modes and details of the present invention can be changed in various ways without departing from the spirit and scope of the present invention. Therefore, the present invention should not be construed as being limited to the following description of the embodiments.

First, a liquid crystal display device according to one embodiment of the present invention is described with reference to FIGS. 1A to 1D, FIGS. 2A and 2B, FIGS. 3A and 3B, FIG. 4, and FIG. 5.

<Structure Example of Liquid Crystal Display Device>

Figure 1A:
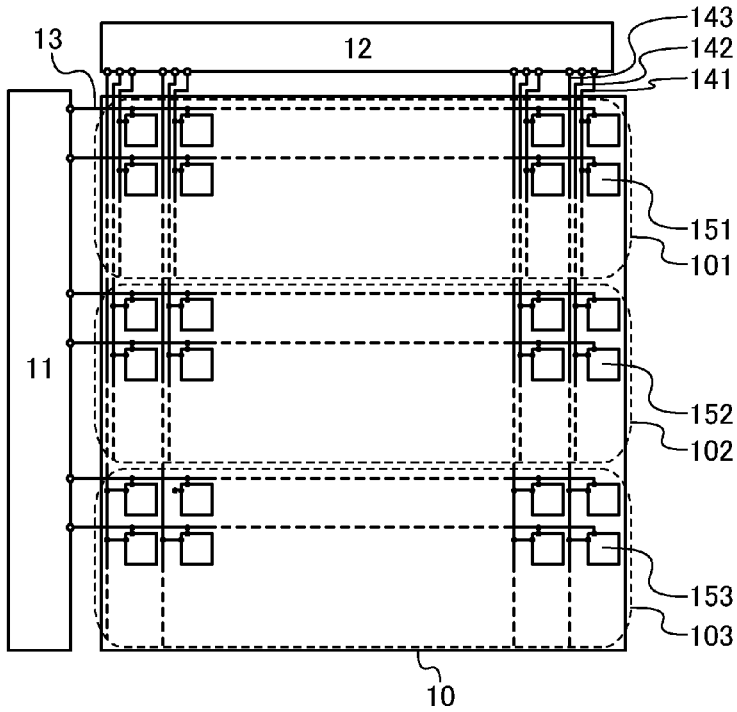
FIG. 1A illustrates a structure example of a liquid crystal display device.

FIG. 1A illustrates a structure example of a liquid crystal display device. The liquid crystal display device illustrated in FIG. 1A includes a pixel portion 10; a scan line driver circuit 11; a signal line driver circuit 12; m (m is a natural number that is 3 or more) scan lines 13 which are arranged parallel or almost parallel to each other and whose potentials are controlled by the scan line driver circuit 11, n (n is a natural number that is 2 or more) signal lines 141, n signal lines 142, and n signal lines 143 which are arranged parallel or almost parallel to each other and whose potentials are controlled by the signal line driver circuit 12.

The pixel portion 10 is divided into three regions (regions 101 to 103) and includes a plurality of pixels which are arranged in matrix in each region. Note that the region 101 is a region including the scan lines 13 which are provided in the first to k-th (k is a natural number that is less than m/2) rows; the region 102 is a region including the scan lines 13 which are provided in the (k+1)th to 2k-th rows; and the region 103 is a region including the scan lines 13 which are provided in the (2k+1)th to m-th rows. Note that the scan line 13 is electrically connected to n pixels provided in a corresponding row among the plurality of pixels arranged in matrix (m rows by n columns) in the pixel portion 10. In addition, the signal line 141 is electrically connected to n pixels provided in a corresponding column among the plurality of pixels arranged in matrix in the region 101. Furthermore, the signal line 142 is electrically connected to n pixels provided in a corresponding column among the plurality of pixels arranged in matrix in the region 102. In addition, the signal line 143 is electrically connected to n pixels provided in a corresponding column among the plurality of pixels arranged in matrix in the region 103.

Note that signals such as a start pulse (GSP) for the scan line driver circuit, a clock signal (GCK) for the scan line driver circuit, and pulse-width control signals (PWC1, PWC2) for the scan line driver circuit, and drive power supply potentials such as a high power supply potential and a low power supply potential are input to the scan line driver circuit 11 from the outside. Further, signals such as a start pulse (SSP) for the signal line driver circuit, a clock signal (SCK) for the signal line driver circuit, and image signals (DATA1 to DATA3), and drive power supply potentials such as a high power supply potential and a low power supply potential are input to the signal line driver circuit 12 from the outside.

Figure 1B:
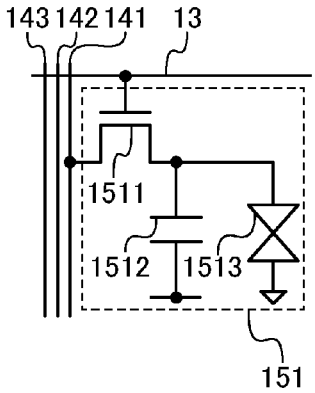
FIGS. 1B to 1D illustrate structure examples of pixels.
Figure 1C:
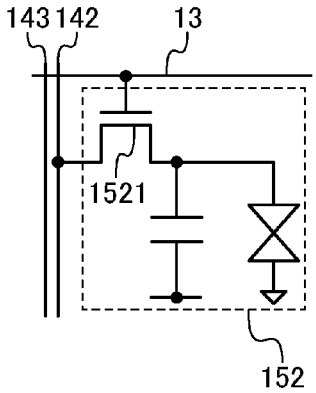
Figure 1D:
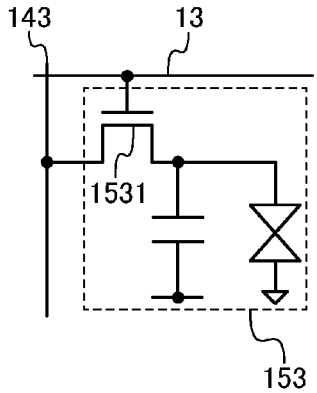

FIGS. 1B to 1D illustrate examples of the circuit structures of pixels. Specifically, FIG. 1B illustrates an example of the circuit structure of a pixel 151 provided in the region 101; FIG. 1C illustrates an example of the circuit structure of a pixel 152 provided in the region 102; and FIG. 1D illustrates an example of the circuit structure of a pixel 153 provided in the region 103. The pixel 151 illustrated in FIG. 1B includes a transistor 1511, a capacitor 1512, and a liquid crystal element 1513. A gate of the transistor 1511 is electrically connected to the scan line 13. One of a source and a drain of the transistor 1511 is electrically connected to the signal line 141. One electrode of the capacitor 1512 is electrically connected to the other of the source and the drain of the transistor 1511. The other electrode of the capacitor 1512 is electrically connected to a wiring (also called a capacitor wiring) for supplying a capacitor potential. One electrode (also called a pixel electrode) of the liquid crystal element 1513 is electrically connected to the other of the source and the drain of the transistor 1511 and the one electrode of the capacitor 1512. The other electrode (also called a counter electrode) of the liquid crystal element 1513 is electrically connected to a wiring for supplying a counter potential.

The circuit structures of the pixel 152 illustrated in FIG. 1C and the pixel 153 illustrated in FIG. 1D are the same as that of the pixel 151 illustrated in FIG. 1B. Note that the pixel 152 illustrated in FIG. 1C differs from the pixel 151 illustrated in FIG. 1B in that one of a source and a drain of a transistor 1521 is electrically connected to the signal line 142 instead of the signal line 141; and the pixel 153 illustrated in FIG. 1D differs from the pixel 151 illustrated in FIG. 1B in that one of a source and a drain of a transistor 1531 is electrically connected to the signal line 143 instead of the signal line 141.

<Structure Example of Scan Line Driver Circuit 11>

Figure 2A:
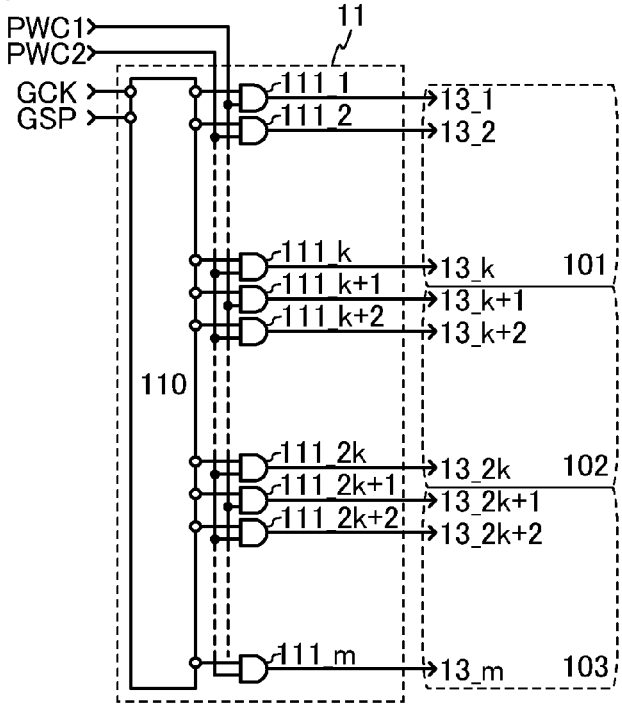
FIG. 2A illustrates a structure example of a scan line driver circuit.

FIG. 2A illustrates a structure example of the scan line driver circuit 11 included in the liquid crystal display device illustrated in FIG. 1A. The scan line driver circuit 11 illustrated in FIG. 2A includes a shift register 110 having m output terminals and AND gates 111_1 to 111_*m* each having a first input terminal, a second input terminal, and an output terminal. Note that the first input terminal of the AND gate 111_*a* (a is an odd number that is m or less) is electrically connected to the a-th output terminal of the shift register 110; the second input terminal of the AND gate 111_*a* is electrically connected to a wiring for supplying the first pulse-width control signal (PWC1); and the output terminal of the AND gate 111_*a* is electrically connected to the scan line 13_*a* that is provided in the a-th row in the pixel portion 10. Further, the first input terminal of the AND gate 111_*b* (b is an even number that is m or less) is electrically connected to the b-th output terminal of the shift register 110; the second input terminal of the AND gate 111_*b* is electrically connected to a wiring for supplying the second pulse-width control signal (PWC2); and the output terminal of the AND gate 111_*b* is electrically connected to the scan line 13_*b* that is provided in the b-th row in the pixel portion 10.

The shift register 110 sequentially outputs high-level potentials from the first to m-th output terminals when a signal that has a high-level potential is input to the shift register 110 as the start pulse (GSP) for the scan line driver circuit which is input from the outside. Note that in the shift register 110, the output terminals which output high-level potentials are changed every half the cycle of the clock signal (GCK) for the scan line driver circuit. That is, in the shift register 110, a signal that has a high-level potential is shifted every half the cycle of the clock signal (GCK) for the scan line driver circuit and the signals are sequentially output from the m output terminals. In addition, the shift register 110 stops the shift of the signal when supply of the clock signal (GCK) for the scan line driver circuit from the outside is stopped.

An operation example of the scan line driver circuit 11 is described with reference to FIG. 2B. Note that in FIG. 2B, the start pulse (GSP) for the scan line driver circuit, the clock signal (GCK) for the scan line driver circuit, signals (SR110out) output from the m output terminals of the shift register 110, the first pulse-width control signal (PWC1), the second pulse-width control signal (PWC2), and potentials of the scan lines 13_1 to 13_*m* are shown.

Figure 2B:
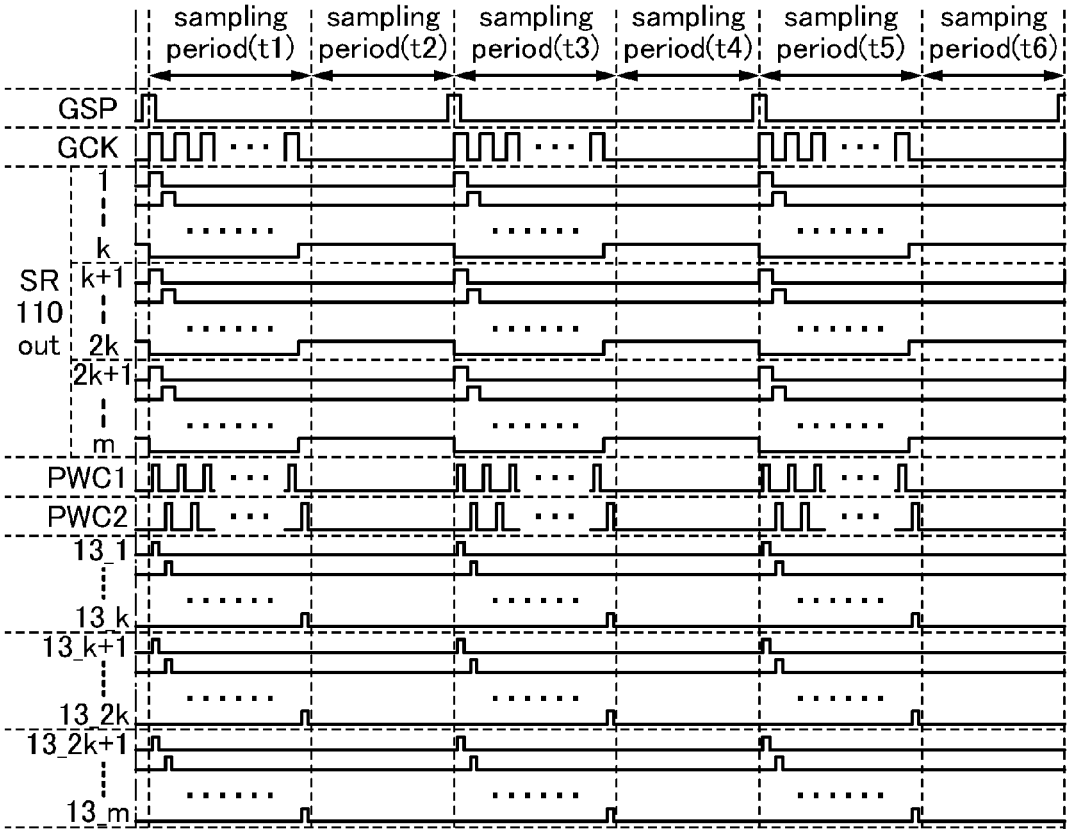
FIG. 2B illustrates an example of operation of a scan line driver circuit.

In the operation example illustrated in FIG. 2B, the start pulse (GSP) for the scan line driver circuit is input to the shift register 110 at least three times before a sampling period (t1). Specifically, in the sampling period (t1), the start pulse (GSP) for the scan line driver circuit is input so that the first to k-th output terminals of the shift register 110 sequentially output high-level potentials, the (k+1)th to 2k-th output terminals sequentially output high-level potentials, and the (2k+1)th to m-th output terminals sequentially output high-level potentials.

Accordingly, in the sampling period (t1), each of the AND gates 111_1 to 111_*m* outputs a logical AND of any of the signals output from the m output terminals of the shift register 110 and any of the first pulse-width control signal (PWC1) and the second pulse-width control signal (PWC2). In other words, in the sampling period (t1), high-level potentials (selection signals) are sequentially supplied to the scan lines 13_1 to 13_*k* which are provided in the first to k-th rows, high-level potentials (selection signals) are sequentially supplied to the scan lines 13_*k*+1 to 13_2k which are provided in the (k+1)th to 2k-th rows, and high-level potentials (selection signals) are sequentially supplied to the scan lines 13_2k+1 to 13_*m* which are provided in the (2k+1)th to m-th rows. Note that the length of a period (a horizontal scanning period) in which a high-level potential is supplied to the scan line is substantially the same as that of a period in which the potential of the first pulse-width control signal (PWC1) or the second pulse-width control signal (PWC2) is high-level. In this manner, in the sampling period (t1), the scan line driver circuit 11 can supply selection signals to 3n pixels provided in three rows and the three rows to which the selection signals are supplied are shifted every half the cycle of the clock signal (GCK) for the scan line driver circuit.

Then, in a sampling period (t2), supply of the clock signal (GCK) for the scan line driver circuit, the first pulse-width control signal (PWC1), and the second pulse-width control signal (PWC2) to the scan line driver circuit 11 is stopped. Specifically, low-level potentials are supplied to wirings for supplying these signals. Thus, the shift of the signal having a high-level potential in the shift register 110 is stopped and low-level potentials (non-selection signals) are supplied to the scan lines 13_1 to 13_*m*.

Then, in a sampling period (t3), supply of the clock signal (GCK) for the scan line driver circuit, the first pulse-width control signal (PWC1), and the second pulse-width control signal (PWC2) to the scan line driver circuit 11 is started again. Further, just before the clock signal (GCK) for the scan line driver circuit is supplied, the start pulse (GSP) for the scan line driver circuit is input to the scan line driver circuit 11. This input enables operation similar to operation in the sampling period (t1) to be performed in the sampling period (t3). That is, in the sampling period (t3), the scan line driver circuit 11 can supply selection signals to 3n pixels provided in three rows and the three rows to which the selection signals are supplied are shifted every half the cycle of the clock signal (GCK) for the scan line driver circuit.

In the operation example illustrated in FIG. 2B, the above-described series of operations is repeated in the following periods. In other words, in this operation example, a series of a sampling period in which selection signals can be supplied to 3n pixels provided in three rows and the three rows to which the selection signals are supplied are shifted every half the cycle of the clock signal (GCK) for the scan line driver circuit and a sampling period in which non-selection signals are supplied to all the pixels is repeated.

<Structure Example of Signal Line Driver Circuit 12>

Figure 3A:
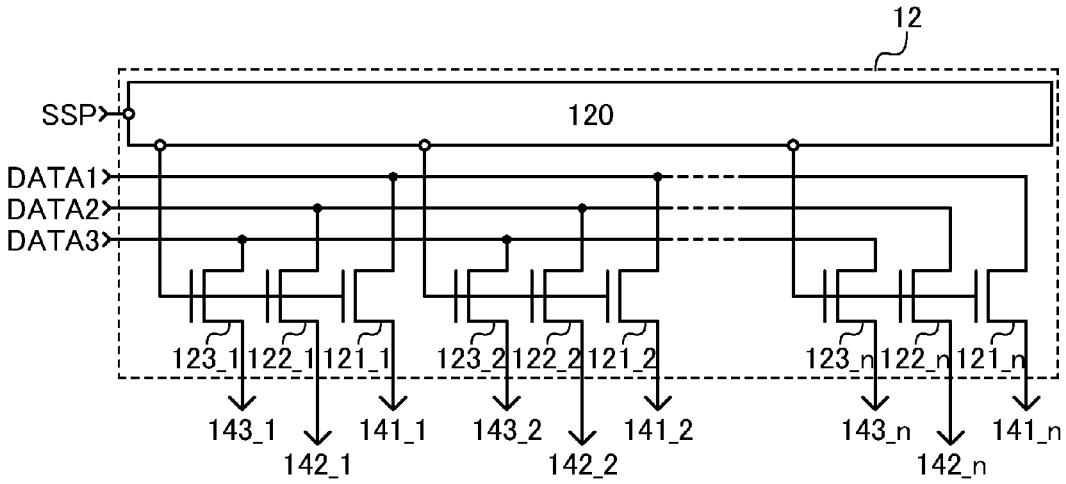
FIG. 3A illustrates a structure example of a signal line driver circuit.

FIG. 3A illustrates a structure example of the signal line driver circuit 12 which is included in the liquid crystal display device illustrated in FIG. 1A. The signal line driver circuit 12 illustrated in FIG. 3A includes a shift register 120 having n output terminals, transistors 121_1 to 121_*n*, transistors 122_1 to 122_*n*, and transistors 123_1 to 123_*n*. Note that a gate of the transistor 121_*s* (s is a natural number that is n or less) is electrically connected to the s-th output terminal of the shift register 120; one of a source and a drain of the transistor 121_*s* is electrically connected to a wiring for supplying the first image signal (DATA1); and the other of the source and the drain of the transistor 121_*s* is electrically connected to the signal line 141_*s* provided in the s-th column in the pixel portion 10. Further, a gate of the transistor 122_*s* is electrically connected to the s-th output terminal of the shift register 120; one of a source and a drain of the transistor 122_*s* is electrically connected to a wiring for supplying the second image signal (DATA2); and the other of the source and the drain of the transistor 122_*s* is electrically connected to the signal line 142_*s* provided in the s-th column in the pixel portion 10. Further, a gate of the transistor 123_*s* is electrically connected to the s-th output terminal of the shift register 120; one of a source and a drain of the transistor 123_*s* is electrically connected to a wiring for supplying the third image signal (DATA3); and the other of the source and the drain of the transistor 123_*s* is electrically connected to the signal line 143_*s* provided in the s-th column in the pixel portion 10.

Figure 3B:
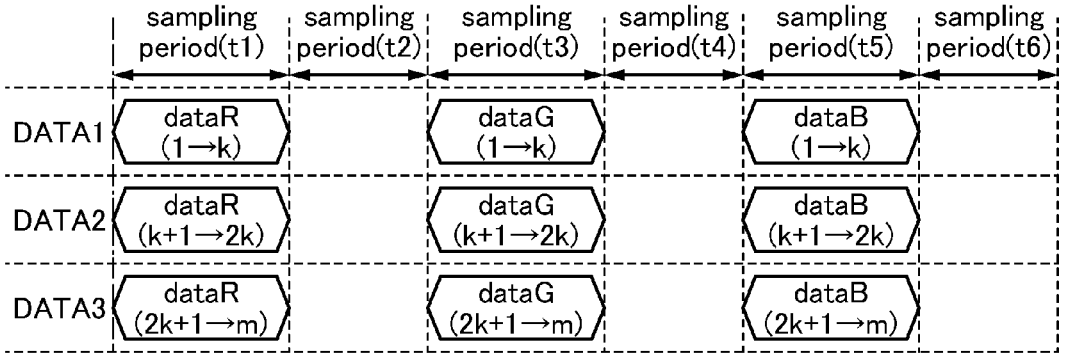
FIG. 3B illustrates an example of operation of a signal line driver circuit.

FIG. 3B illustrates an example of timings of image signals supplied by the wirings for supplying the first image signal (DATA1), the second image signal (DATA2), and the third image signal (DATA3). As illustrated in FIG. 3B, in the sampling period (t1), the wiring for supplying the first image signal (DATA1) supplies an image signal (dataR(1→k)) for controlling transmission of red (R) light for the pixels provided in the first to k-th rows; in the sampling period (t3), the wiring for supplying the first image signal (DATA1) supplies an image signal (dataG(1→k)) for controlling transmission of green (G) light for the pixels provided in the first to k-th rows; in the sampling period (t5), the wiring for supplying the first image signal (DATA1) supplies an image signal (dataB (1→k)) for controlling transmission of blue (B) light for the pixels provided in the first to k-th rows; and in the other sampling periods (t2, t4, and t6), the wiring for supplying the first image signal (DATA1) does not supply any image signal. Further, in the sampling period (t1), the wiring for supplying the second image signal (DATA2) supplies an image signal (dataR(k+1→2k)) for controlling transmission of red (R) light for the pixels provided in the (k+1)th to 2k-th rows; in the sampling period (t3), the wiring for supplying the second image signal (DATA2) supplies an image signal (dataG(k+1→2k)) for controlling transmission of green (G) light for the pixels provided in the (k+1)th to 2k-th rows; in the sampling period (t5), the wiring for supplying the second image signal (DATA2) supplies an image signal (dataB(k+1→2k)) for controlling transmission of blue (B) light for the pixels provided in the (k+1)th to 2k-th rows; and in the other sampling periods (t2, t4, and t6), the wiring for supplying the second image signal (DATA2) does not supply any image signal. Further, in the sampling period (t1), the wiring for supplying the third image signal (DATA3) supplies an image signal (dataR(2k+1m)) for controlling transmission of red (R) light for the pixels provided in the (2k+1)th to m-th rows; in the sampling period (t3), the wiring for supplying the third image signal (DATA3) supplies an image signal (dataG(2k+1→m)) for controlling transmission of green (G) light for the pixels provided in the (2k+1)th to m-th rows; in the sampling period (t5), the wiring for supplying the third image signal (DATA3) supplies an image signal (dataB(2k+1→m)) for controlling transmission of blue (B) light for the pixels provided in the (2k+1)th to m-th rows; and in the other sampling periods (t2, t4, and t6), the wiring for supplying the third image signal (DATA3) does not supply any image signal.

<Structure Example of Backlight>

Figure 4:
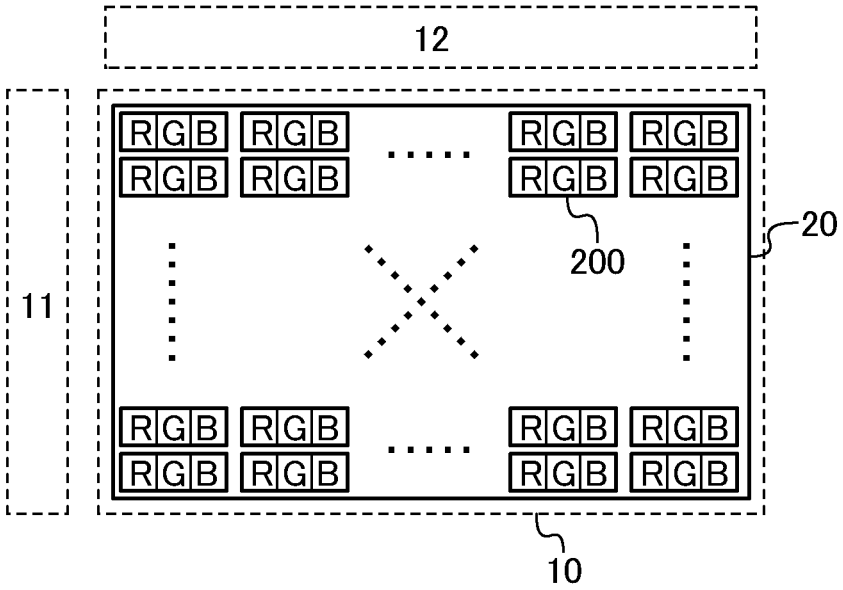
FIG. 4 illustrates a structure example of a backlight.

FIG. 4 illustrates a structure example of a backlight 20 provided behind the pixel portion 10 in the liquid crystal display device illustrated in FIG. 1A. In the backlight illustrated in FIG. 4, backlight units 200 each including three light sources which emit light of respective colors of red (R), green (G), and blue (B) are arranged in matrix. Note that light emitting diodes (LEDs) or the like can be used as the light sources.

<Operation Example of Liquid Crystal Display Device>

Figure 5:
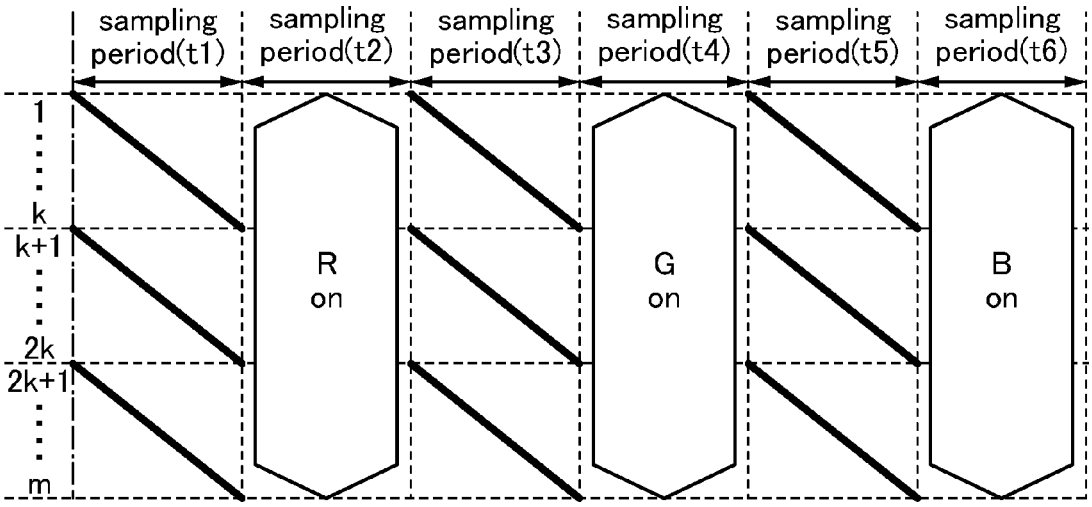
FIG. 5 illustrates an operation example of a liquid crystal display device.

FIG. 5 illustrates a shift of the selection signals and timing of lighting the backlight in the above-described liquid crystal display device. Note that in FIG. 5, the vertical axis indicates the rows in the pixel portion 10 and the horizontal axis indicates time. In the liquid crystal display device, in the sampling period (t1), the respective n pixels 151 provided in the first to k-th rows are sequentially selected for each row; the respective n pixels 152 provided in the (k+1)th to 2k-th rows are sequentially selected for each row; and the respective n pixels 153 provided in the (2k+1)th to m-th rows are sequentially selected for each row. Thus, an image signal for controlling transmission of red (R) light can be input to each pixel. Similarly, in the liquid crystal display device, in the sampling period (t3), an image signal for controlling transmission of green (G) light can be input to each pixel, and in the sampling period (t5), an image signal for controlling transmission of blue (B) light can be input to each pixel.

Moreover, in the liquid crystal display device, in the sampling period (t2), red (R) light is emitted from the backlight 20 to the pixel portion 10; in the sampling period (t4), green (G) light is emitted from the backlight 20 to the pixel portion 10; and in the sampling period (t6), blue (B) light is emitted from the backlight 20 to the pixel portion 10.

<Liquid Crystal Display Device of This Embodiment>

In the liquid crystal display device disclosed in this specification, image signals can be concurrently supplied to pixels provided in a plurality of rows among pixels arranged in matrix. Thus, without being limited by the characteristics such as mobility of a transistor included in the liquid crystal display device, the frequency of input of an image signal to each pixel can be increased. As a result, in the liquid crystal display device, display deterioration such as color break which is caused in a field-sequential liquid crystal display device can be suppressed and image quality can be improved.

<Modification Example>

The above-described liquid crystal display device is one embodiment of the present invention, and the present invention includes a liquid crystal display device which is different from the above-described liquid crystal display device.

For example, the above-described liquid crystal display device has the structure in which the pixel portion 10 is divided into three regions; however, the liquid crystal display device of the present invention is not limited to having this structure. In other words, in the liquid crystal display device in the present invention, the pixel portion 10 can be divided into a plurality of regions the number of which is not three. Note that it is obvious that in the case where the number of regions is changed, the number of regions needs to be equal to the number of signal lines and timing of inputting the start pulse (GSP) for the scan line driver circuit needs to be controlled appropriately.

Further, the liquid crystal display device includes a capacitor for holding voltage applied to a liquid crystal element (see FIGS. 1B to 1D); however, it is possible not to provide the capacitor. In that case, the aperture ratio of the pixel can be improved. In addition, since the capacitor wiring extending to the pixel portion can be omitted, a variety of wirings can be driven at high speed.

Figure 6A:
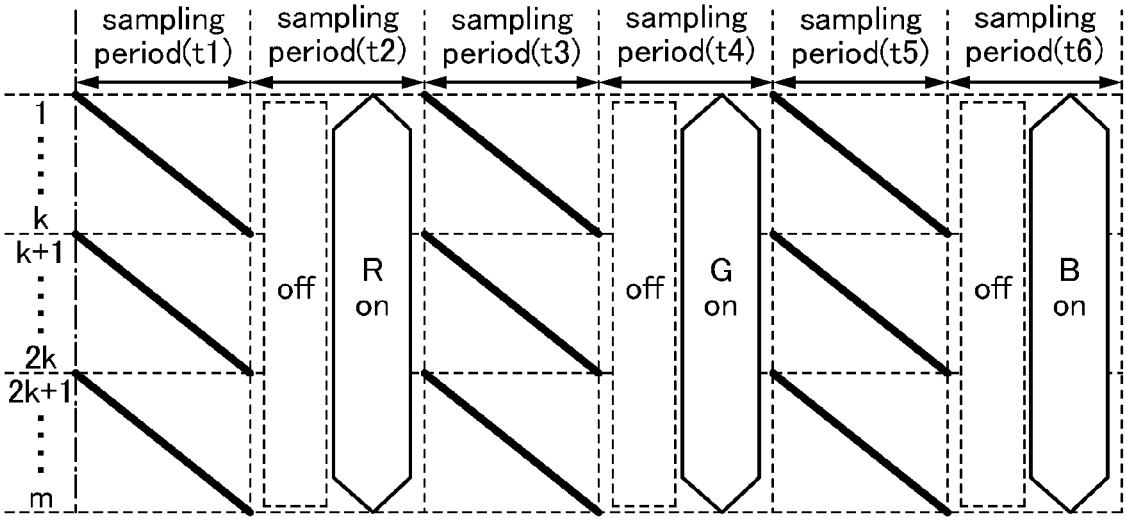
FIGS. 6A and 6B illustrate operation examples of liquid crystal display devices.

Further, in the above-described liquid crystal display device, a period (a shutoff period) in which the backlight is not lit can be provided at the beginning of each of the sampling periods (t2, t4, and t6) as illustrated in FIG. 6A. In that case, a response time of the liquid crystal elements of the pixels (e.g., the pixels provided in the k-th row and the 2k-th row in the pixel portion) to which the image signals are input at the end of the sampling periods (t1, t3, and t5) can be secured. In other words, light leakage in the pixels can be suppressed.

Figure 6B:
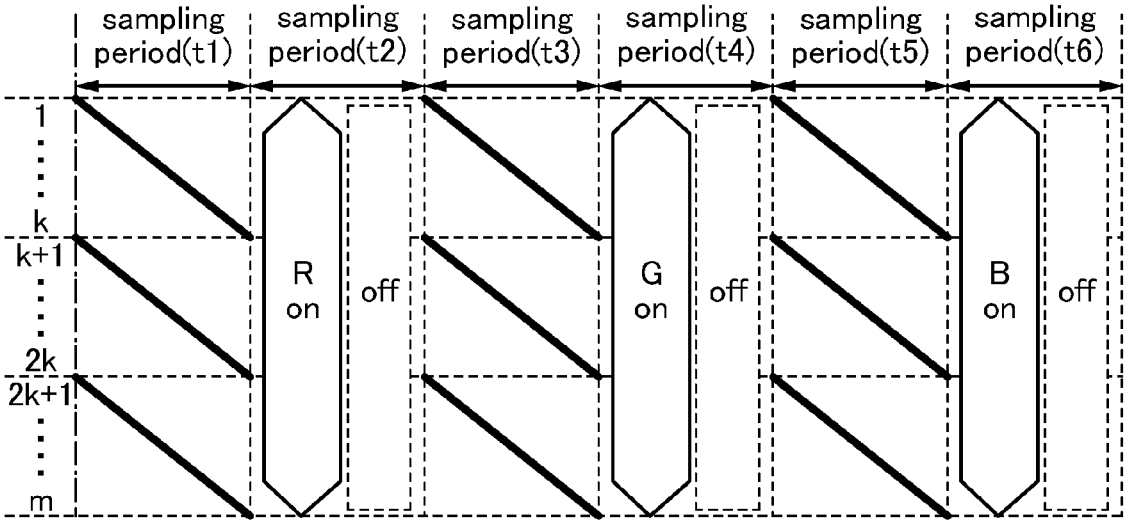

Further, a period (a shutoff period) in which the backlight is not lit can be provided at the end of each of the sampling periods (t2, t4, and t6) as illustrated in FIG. 6B. In that case, a period can be secured in which the polarity of the counter potential supplied to the other electrode (the counter electrode) of the liquid crystal element of the liquid crystal display device is inverted (this inversion is called common inversion). Note that in many general liquid crystal display devices, the polarity of a voltage which is applied to a liquid crystal element is inverted every predetermined period (i.e., the potential of an image signal input to a pixel is switched between a potential higher than a counter potential and a potential lower than the counter potential every predetermined period) in order to suppress deterioration of the liquid crystal element. By performing common inversion driving, the voltage amplitude of the image signal can be reduced. Note that although the shutoff periods are provided in the sampling periods (t2, t4, and t6) in FIG. 6B, the shutoff period is not necessarily provided in each of all the sampling periods (t2, t4, and t6). For example, the shutoff period can be provided every period in which one image is produced in the pixel portion.

Figure 7A:
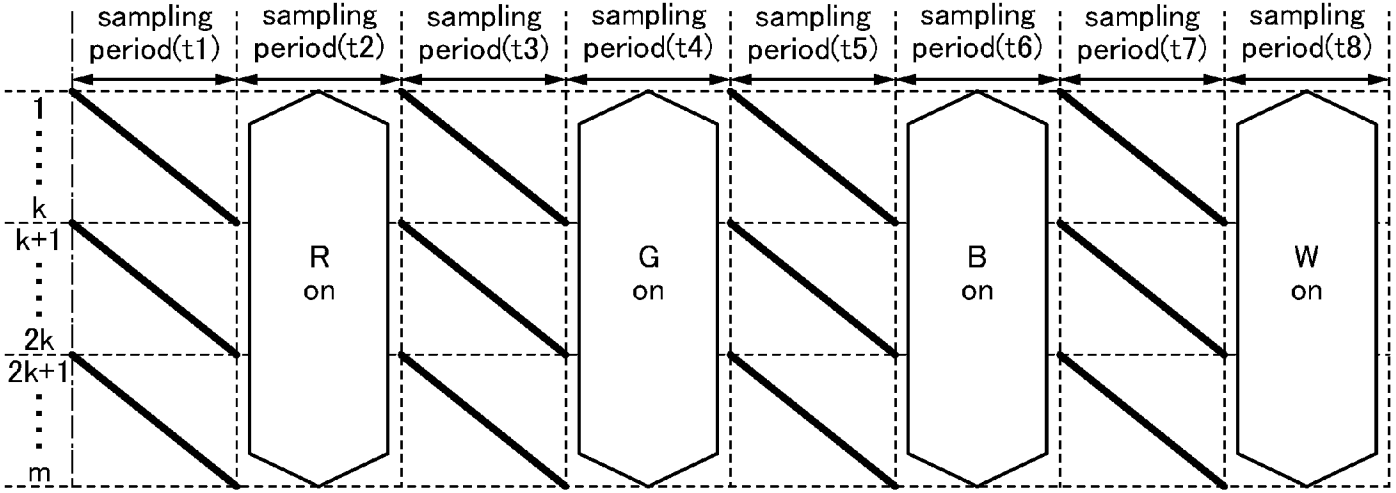
FIGS. 7A and 7B illustrate operation examples of liquid crystal display devices.
Figure 7B:
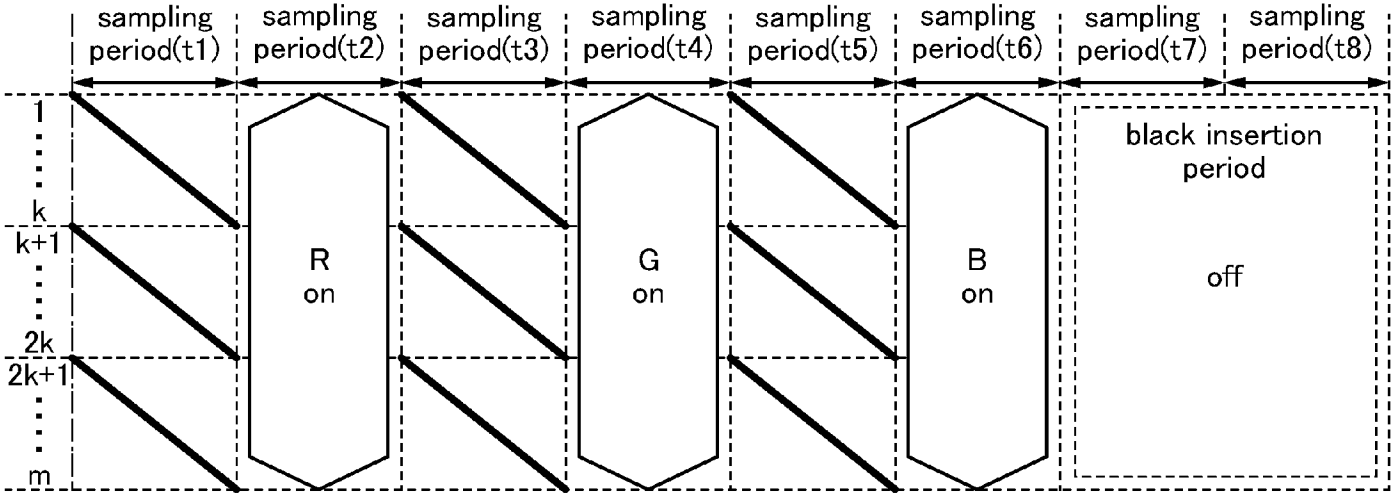

The liquid crystal display device has a structure where the backlight sequentially emits red (R) light, green (G) light, and blue (B) light to the pixel portion (see FIG. 5); however, the structure of the liquid crystal display device of one embodiment of the present invention is not limited to such a structure. For example, a structure (see FIG. 7A) where light sources capable of emitting red (R) light, green (G) light, and blue (B) light are lit at the same time in the backlight, so that white (W) light can be produced and emitted to the pixel portion can be employed. Further, a structure (see FIG. 7B) where a period (a black insertion period) in which the backlight is shut off is provided after an image is produced in the pixel portion can be employed. With the black insertion period, color break can be suppressed. Alternatively, light of a given color, the amount of which is larger than that of light of the other colors, can be emitted to the pixel portion. Specifically, the amount of blue (B) light emitted to the pixel portion, which has a low luminosity factor, can be larger than that of green (G) light emitted to the pixel portion, which has a high luminosity factor.

Furthermore, the liquid crystal display device has a structure where the backlight unit has light sources capable of emitting light of three colors of red (R), green (G), and blue (B); however, the structure of the liquid crystal display device of one embodiment of the present invention is not limited to such a structure. In other words, in the liquid crystal display device of one embodiment of the present invention, the backlight unit can be formed by arbitrarily combining plural light sources that emit light of different colors. For example, combination of light sources that emit light of four colors of red (R), green (G), blue (B), and white (W) or four colors of red (R), green (G), blue (B), and yellow (Y), combination of light sources that emit light of a plurality of complementary colors, and the like are possible. Note that in the case where the backlight unit includes a light source emitting white (W) light, white (W) light can be produced by the light source without mixture of colors. Since the light source has high luminous efficiency, power consumption can be reduced by forming the backlight unit using the light source. Further, in the case where the backlight unit includes light sources that emit light of two complementary colors (e.g., light sources that emit two colors of blue (B) and yellow (Y)), white (W) light can be produced by mixture of the light of the two colors. Further, light sources that emit light of six colors of pale red (R), pale green (G), pale blue (B), deep red (R), deep green (G), and deep blue (B) can be used in combination or light sources that emit light of six colors of red (R), green (G), blue (B), cyan (C), magenta (M), and yellow (Y) can be used in combination. In this manner, by a combination of light sources that emit light of a larger number of colors, the color gamut of the liquid crystal display device can be increased, so that image quality can be improved.

A shift of the selection signals and lighting of the backlight are performed in different periods in the liquid crystal display device (see FIG. 5, FIGS. 6A and 6B, and FIGS. 7A and 7B); however, the structure of the liquid crystal display device in the present invention is not limited to such a structure. For example, a structure where a shift of the selection signals and lighting of the backlight are concurrently performed can be employed. A specific example of the structure will be described below with reference to FIGS. 8A and 8B and FIG. 9.

Figure 8A:
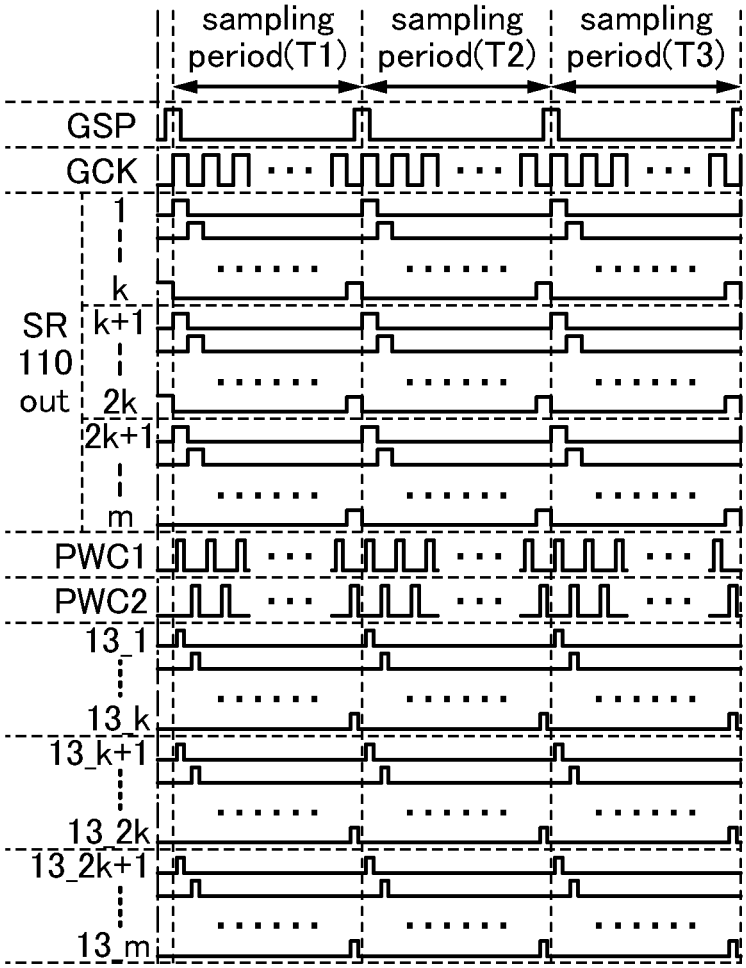
FIG. 8A illustrates an example of operation of a scan line driver circuit.

FIG. 8A illustrates an operation example of a scan line driver circuit. Note that the scan line driver circuit 11 the structure of which is illustrated in FIG. 2A can be applied to the scan line driver circuit here. In the operation example illustrated in FIG. 8A, operations in sampling periods (T1, T2, and T3) are the same as those in the sampling periods (t1, t3, and t5) in the operation example of the scan line driver circuit in FIG. 2B. In other words, the operation example illustrated in FIG. 8A is the operation example of the scan line driver circuit in FIG. 2B from which the sampling periods (t2, t4, and t6) are omitted.

Figure 8B:
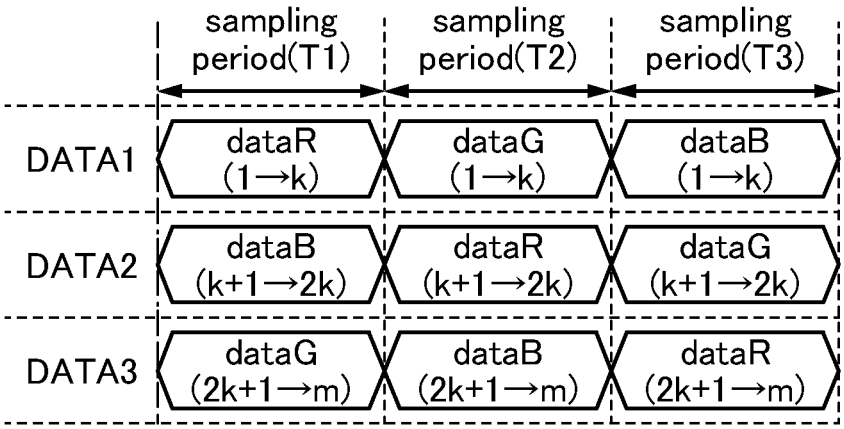
FIG. 8B illustrates an example of operation of a signal line driver circuit.

FIG. 8B illustrates an operation example of a signal line driver circuit. Note that the signal line driver circuit 12 the structure of which is illustrated in FIG. 3A can be applied to the signal line driver circuit here. In the operation example illustrated in FIG. 8B, in the sampling period (T1), the wiring for supplying the first image signal (DATA1) supplies an image signal (dataR(1→k)) for controlling transmission of red (R) light for the pixels provided in the first to k-th rows; in the sampling period (T2), the wiring for supplying the first image signal (DATA1) supplies an image signal (dataG (1→k)) for controlling transmission of green (G) light for the pixels provided in the first to k-th rows; and in the sampling period (T3), the wiring for supplying the first image signal (DATA1) supplies an image signal (dataB(1→k)) for controlling transmission of blue (B) light for the pixels provided in the first to k-th rows. Further, in the sampling period (T1), the wiring for supplying the second image signal (DATA2) supplies an image signal (dataB(k+1→2k)) for controlling transmission of blue (B) light for the pixels provided in the (k+1)th to 2k-th rows; in the sampling period (T2), the wiring for supplying the second image signal (DATA2) supplies an image signal (dataR(k+1→2k)) for controlling transmission of red (R) light for the pixels provided in the (k+1)th to 2k-th rows; and in the sampling period (T3), the wiring for supplying the second image signal (DATA2) supplies an image signal (dataG(k+1→2k)) for controlling transmission of green (G) light for the pixels provided in the (k+1)th to 2k-th rows. Further, in the sampling period (T1), the wiring for supplying the third image signal (DATA3) supplies an image signal (dataG(2k+1→m)) for controlling transmission of green (G) light for the pixels provided in the (2k+1)th to m-th rows; in the sampling period (T2), the wiring for supplying the third image signal (DATA3) supplies an image signal (dataB(2k+1→m)) for controlling transmission of blue (B) light for the pixels provided in the (2k+1)th to m-th rows; and in the sampling period (T3), the wiring for supplying the third image signal (DATA3) supplies an image signal (dataR(2k+1→m)) for controlling transmission of red (R) light for the pixels provided in the (2k+1)th to m-th rows.

Further, as a backlight, a backlight having the structure illustrated in FIG. 4 can be used. Here, note that lighting of the plurality of the backlight units 200 arranged in matrix can be controlled for each given region. Specifically, the backlight units 200 are provided at least every t rows and every n columns (here, t is k/4) as the backlight for the pixels arranged in matrix (m rows by n columns) and lighting of the backlight units 200 can be controlled independently. In other words, the backlight can include at least a first group of backlight units for the first to t-th rows to a (3k/t)th group of backlight units for the (2k+3t+1)th to m-th rows, and lighting of the backlight units 200 can be controlled independently.

Figure 9:
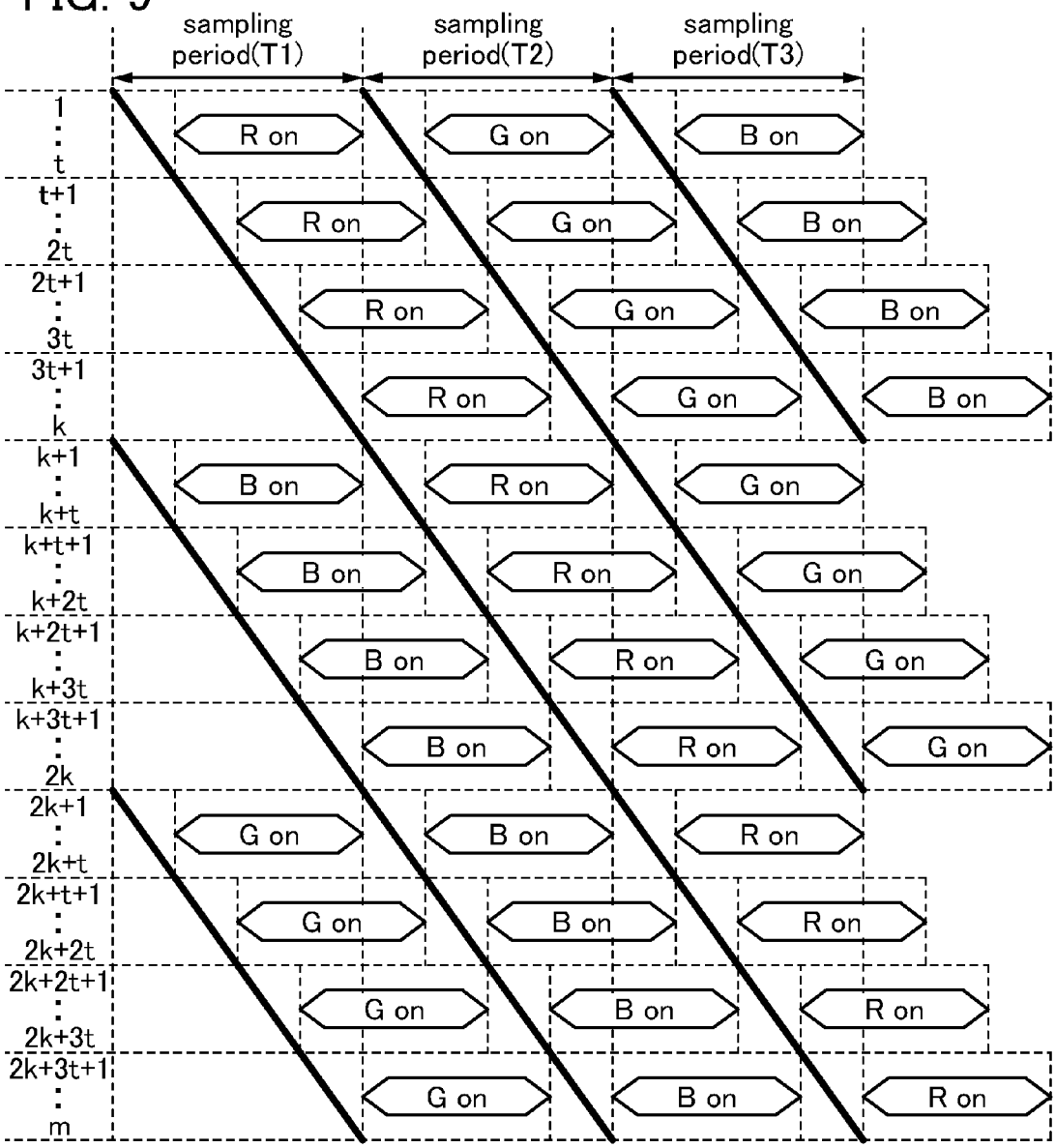
FIG. 9 illustrates an operation example of a liquid crystal display device.

FIG. 9 illustrates a shift of the selection signals and timing of lighting the backlight in the above-described liquid crystal display device. Note that in FIG. 9, the vertical axis indicates the rows in the pixel portion 10 and the horizontal axis indicates time. In the liquid crystal display device, in the sampling period (T1), the respective n pixels provided in the first to k-th rows are sequentially selected; the respective n pixels provided in the (k+1)th to 2k-th rows are sequentially selected; and the respective n pixels provided in the (2k+1)th to m-th rows are sequentially selected. Thus, the image signal can be input to each pixel. Further, in the liquid crystal display device, in the sampling period (T1), red (R) light is emitted from the backlight units for the first to t-th rows after the red (R) image signals are input to the respective n pixels provided in the first to t-th rows; blue (B) light is emitted from the backlight units for the (k+1)th to (k+t)th rows after the blue (B) image signals are input to the respective n pixels provided in the (k+1)th to (k+t)th rows; and green (G) light is emitted from the backlight units for the (2k+1)th to (2k+t)th rows after the green (G) image signals are input to the respective n pixels provided in the (2k+1)th to (2k+t)th rows. In other words, in the liquid crystal display device, a shift of the selection signals and lighting of the backlight unit of a given color (red (R), green (G), or blue (B)) can be concurrently performed per region (a region of the first to n-th rows, a region of the (n+1)th to 2n-th rows, and a region of the (2n+1)th to 3n-th rows). Thus, without being limited by the characteristics such as mobility of a transistor included in the liquid crystal display device, the frequency of input of an image signal to each pixel can be increased. As a result, in the liquid crystal display device, display deterioration such as color break which is caused in a field-sequential liquid crystal display device can be suppressed and image quality can be improved.

The structures in Modification Example can be applied in combination to the liquid crystal display device which is described with reference to FIGS. 1A to 1D, FIGS. 2A and 2B, FIGS. 3A and 3B, FIG. 4, and FIG. 5.

<Various Kinds of Electronic Devices Having Liquid Crystal Display Device>

Examples of electronic devices each having the above-described liquid crystal display device are described below with reference to FIGS. 10A to 10F.

Figure 10A:
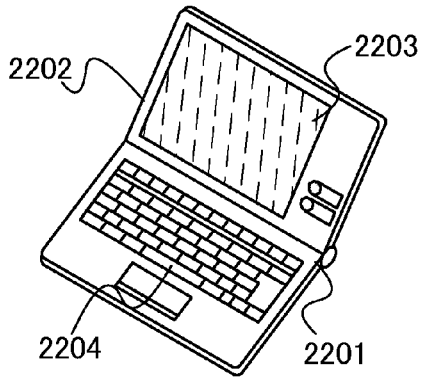
FIGS. 10A to 10F illustrate examples of electronic devices.

FIG. 10A illustrates a laptop personal computer, which includes a main body 2201, a housing 2202, a display portion 2203, a keyboard 2204, and the like.

Figure 10B:
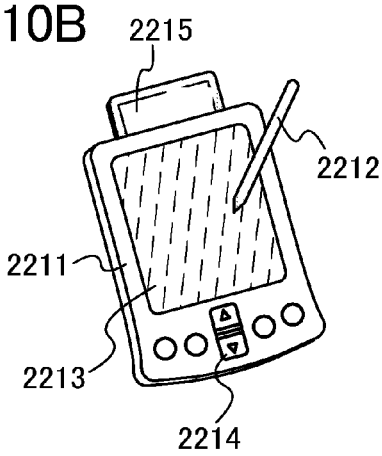

FIG. 10B illustrates a portable information terminal (PDA), which includes a main body 2211 provided with a display portion 2213, an external interface 2215, operation buttons 2214, and the like. Further, a stylus 2212 for operation is included as an accessory.

Figure 10C:
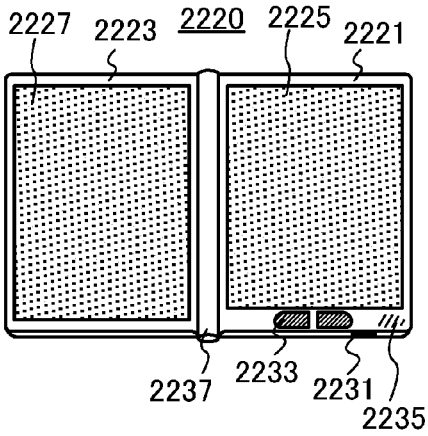

FIG. 10C illustrates an e-book reader 2220. The e-book reader 2220 includes two housings 2221 and 2223. The housings 2221 and 2223 are combined with each other with a hinge 2237 so that the e-book reader 2220 can be opened and closed with the hinge 2237 used as an axis. With such a structure, the e-book reader 2220 can be used like a paper book.

A display portion 2225 is incorporated in the housing 2221, and a display portion 2227 is incorporated in the housing 2223. The display portions 2225 and 2227 may display one image or different images. In the case where the display portions 2225 and 2227 display different images, for example, a display portion on the right side (the display portion 2225 in FIG. 10C) can display text and a display portion on the left side (the display portion 2227 in FIG. 10C) can display images.

Further, in FIG. 10C, the housing 2221 includes an operation portion and the like. For example, the housing 2221 includes a power button 2231, operation keys 2233, a speaker 2235, and the like. With the operation key 2233, pages can be turned. Note that a keyboard, a pointing device, or the like may be provided on the same surface as the display portion of the housing. Further, an external connection terminal (e.g., an earphone terminal, a USB terminal, or a terminal which can be connected to an AC adapter or a variety of cables such as USB cables), a recording medium insertion portion, or the like may be provided on a back surface or a side surface of the housing. Furthermore, the e-book reader 2220 may function as an electronic dictionary.

The e-book reader 2220 may transmit and receive data wirelessly. Through wireless communication, desired book data or the like can be purchased and downloaded from an electronic book server.

Figure 10D:
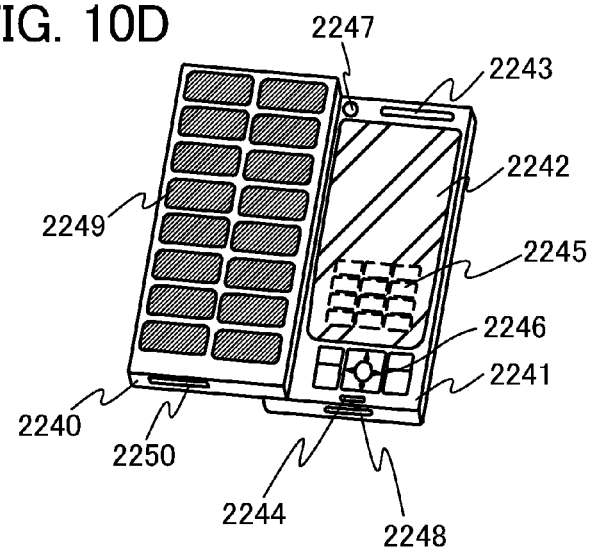

FIG. 10D illustrates a cellular phone. The cellular phone includes two housings 2240 and 2241. The housing 2241 includes a display panel 2242, a speaker 2243, a microphone 2244, a pointing device 2246, a camera lens 2247, an external connection terminal 2248, and the like. The housing 2240 includes a solar cell 2249 for storing electricity in the cellular phone, an external memory slot 2250, and the like. Further, an antenna is incorporated in the housing 2241.

The display panel 2242 has a touch panel function. A plurality of operation keys 2245 which are displayed as images are indicated by dashed lines in FIG. 10D. Note that the cellular phone includes a booster circuit for increasing a voltage output from the solar cell 2249 to a voltage needed for each circuit. Further, the cellular phone can include a contactless IC chip, a small recording device, or the like in addition to the above components.

The display direction of the display panel 2242 is changed as appropriate in accordance with applications. Further, the camera lens 2247 is provided on the same surface as the display panel 2242; thus, the cellular phone can be used as a video phone. The speaker 2243 and the microphone 2244 can be used for videophone calls, recording, and playing sound, and the like as well as voice calls. Furthermore, the housings 2240 and 2241 which are developed as illustrated in FIG. 10D can overlap with each other by sliding; thus, the size of the cellular phone can be decreased, which makes the cellular phone suitable for being carried.

The external connection terminal 2248 can be connected to an AC adapter or a variety of cables such as USB cables, so that electricity can be stored and data communication can be performed. In addition, a larger amount of data can be saved and moved with a recording medium which is inserted to the external memory slot 2250. Further, in addition to the above functions, the cellular phone may have an infrared communication function, a television reception function, or the like.

Figure 10E:
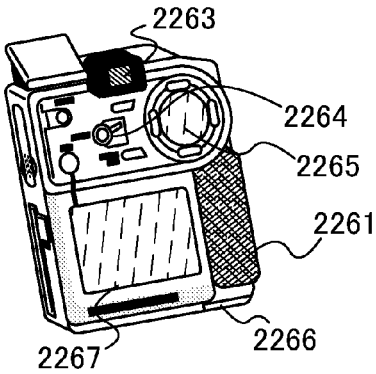

FIG. 10E illustrates a digital camera. The digital camera includes a main body 2261, a display portion (A) 2267, an eyepiece portion 2263, an operation switch 2264, a display portion (B) 2265, a battery 2266, and the like.

Figure 10F:
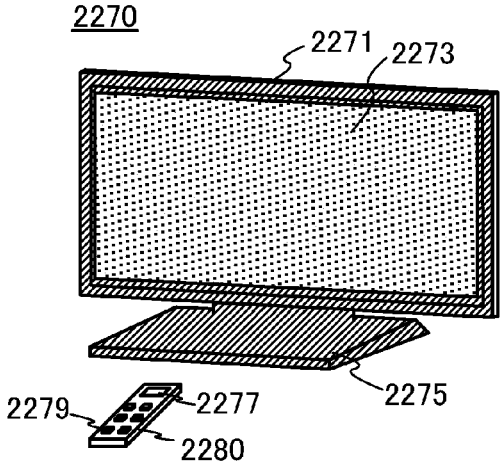

FIG. 10F illustrates a television set. A television set 2270 includes a display portion 2273 incorporated in a housing 2271. The display portion 2273 can display images. Note that here, the housing 2271 is supported by a stand 2275.

The television set 2270 can be operated by an operation switch of the housing 2271 or a remote control 2280. Channels and volume can be controlled with operation keys 2279 of the remote control 2280, so that an image displayed on the display portion 2273 can be controlled. Further, the remote control 2280 may have a display portion 2277 for displaying data output from the remote control 2280.

Note that the television set 2270 preferably includes a receiver, a modem, and the like. A general television broadcast can be received with the receiver. Further, when the television set is connected to a communication network with or without wires via the modem, one-way (from a transmitter to a receiver) or two-way (between a transmitter and a receiver or between receivers) data communication can be performed.

This application is based on Japanese Patent Application serial No. 2010-140886 filed with Japan Patent Office on Jun. 21, 2010, the entire contents of which are hereby incorporated by reference.

What is claimed is:

1. A method for driving a liquid crystal display device comprising the steps of:

performing supply of a clock signal to a scan line driver circuit of the liquid crystal display device in a first sampling period;

performing output of a first logic signal from the scan line driver circuit in the first sampling period;

shutting off a light source of the liquid crystal display device in the first sampling period;

stopping the supply of the clock signal to the scan line driver circuit in a second sampling period; and lighting the light source of the liquid crystal display device in the second sampling period.

2. The method for driving the liquid crystal display device according to claim 1, further comprising the steps of:

performing supply of a pulse-width control signal to the scan line driver circuit of the liquid crystal display device in the first sampling period;

performing output of the first logic signal based on the pulse-width control signal from the scan line driver circuit in the first sampling period; and stopping the supply of the pulse-width control signal to the scan line driver circuit in the second sampling period.

3. The method for driving the liquid crystal display device according to claim 2, further comprising the steps of:

performing output of a second logic signal based on the pulse-width control signal from the scan line driver circuit in the first sampling period concurrently with the output of the first logic signal; and stopping the output of the first logic signal and the output of the second logic signal in the second sampling period.

4. The method for driving the liquid crystal display device according to claim 3, further comprising the steps of:

performing output of the first logic signal to a first pixel;

performing output of the second logic signal to a second pixel;

performing supply of a first image signal to the first pixel while performing the output of the first logic signal from the scan line driver circuit; and performing supply of a second image signal to the second pixel while performing the output of the second logic signal from the scan line driver circuit.

5. The method for driving the liquid crystal display device according to claim 4, wherein a plurality of pixels comprising the first pixel and the second pixel are arranged in matrix form, wherein the first pixel is provided in a first row and a first column, and wherein the second pixel is provided in a second row and the first column.

6. A method for driving a liquid crystal display device comprising a scan line driver circuit, the method comprising the steps of:

performing supply of a clock signal to a shift register of the scan line driver circuit in a first sampling period;

performing output of a first signal from the shift register to a first input terminal of a first logical gate in synchronization with the supply of the clock signal in the first sampling period;

performing output of a first logic signal based on the first signal from the shift register in the first sampling period;

shutting off a light source of the liquid crystal display device in the first sampling period;

stopping the supply of the clock signal to the shift register in a second sampling period;

holding the first signal from the shift register to the first input terminal of the first logical gate in the second sampling period;

stopping the output of the first logic signal from the shift register in the second sampling period; and lighting the light source of the liquid crystal display device in the second sampling period.

7. The method for driving the liquid crystal display device according to claim 6, further comprising the steps of:

performing supply of a pulse-width control signal to a second input terminal of the first logical gate of the scan line driver circuit in the first sampling period;

performing output of the first logic signal based on the pulse-width control signal and the first signal from the shift register in the first sampling period; and stopping the supply of the pulse-width control signal to the second input terminal of the first logical gate in the second sampling period.

8. The method for driving the liquid crystal display device according to claim 7, further comprising the steps of:

performing output of a second signal from the shift register to a first input terminal of a second logical gate in synchronization with the supply of the clock signal in the first sampling period;

performing supply of the pulse-width control signal to a second input terminal of the second logical gate of the scan line driver circuit in the first sampling period;

performing output of a second logic signal based on the pulse-width control signal and the second signal from the shift register concurrently with the output of the first logic signal in the first sampling period;

stopping the supply of the pulse-width control signal to the second input terminal of the second logical gate in the second sampling period;

holding the second signal from the shift register to the first input terminal of the second logical gate in the second sampling period; and stopping the output of the second logic signal from the shift register in the second sampling period.

9. The method for driving the liquid crystal display device according to claim 8, further comprising the steps of:

performing output of the first logic signal to a first pixel;

performing output of the second logic signal to a second pixel;

performing supply of a first image signal to the first pixel while performing the output of the first logic signal from the scan line driver circuit; and performing supply of a second image signal to the second pixel while performing the output of the second logic signal from the scan line driver circuit.

10. The method for driving the liquid crystal display device according to claim 9, wherein a plurality of pixels comprising the first pixel and the second pixel are arranged in matrix form, wherein the first pixel is provided in a first row and a first column, and wherein the second pixel is provided in a second row and the first column.

11. A method for driving a liquid crystal display device comprising the steps of:

in a first sampling period:

performing first supply of n image signals for controlling transmission of light of a first color for n pixels provided in a first row to n pixels provided in a k-th row; and performing second supply of n image signals for controlling transmission of light of a second color for n pixels provided in a (k+1)th row to n pixels provided in a 2k-th row; and in a second sampling period subsequent to the first sampling period:

emitting light of the first color to a pixel portion of the liquid crystal display device by lighting at least one of a plurality of light sources;

emitting light of the second color to the pixel portion by lighting at least one of the plurality of light sources;

controlling transmission of the light of the first color in the n pixels provided in the first row to the n pixels provided in the k-th row; and controlling transmission of the light of the second color in the n pixels provided in the (k+1)th row to the n pixels provided in the 2k-th row, wherein the first supply of the n image signals and the second supply of the n image signals are concurrently performed, and wherein n and k are natural numbers.

12. The method for driving the liquid crystal display device according to claim 11, wherein all the plurality of light sources are shut off in the first sampling period, and wherein an image signal is supplied to none of the n pixels provided in the first row to the n pixels provided in the 2k-th row in the second sampling period.

13. The method for driving the liquid crystal display device according to claim 11, further comprising the steps of:

in the second sampling period:

emitting the light of the first color to the pixel portion after the first supply of the n image signals to the n pixels provided in the k-th row and the second supply of the n image signals to the n pixels provided in the 2k-th row.

14. The method for driving the liquid crystal display device according to claim 11, further comprising the steps of:

in the second sampling period:

shutting off all the plurality of light sources after emitting the light of the first color to the pixel portion;

in a third sampling period subsequent to the second sampling period:

performing third supply of n image signals for controlling transmission of light of a third color for the n pixels provided in the first row to the n pixels provided in the k-th row; and performing fourth supply of n image signals for controlling transmission of light of a fourth color for the n pixels provided in the (k+1)th row to the n pixels provided in the 2k-th row, wherein the third supply of the n image signals and the fourth supply of the n image signals are concurrently performed.

15. The method for driving the liquid crystal display device according to claim 14, wherein common inversion driving is performed while shutting off all the plurality of light sources in the second sampling period.

* * * * *